US008643574B2

(12) United States Patent
Miyamoto et al.

(10) Patent No.: US 8,643,574 B2
(45) Date of Patent: Feb. 4, 2014

(54) IMAGING DEVICE

(75) Inventors: Mitsuhide Miyamoto, Kawasaki (JP); Tohru Kohno, Kokubunji (JP); Masato Ishii, Tokyo (JP); Naruhiko Kasai, Yokohama (JP); Hajime Akimoto, Kokubunji (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1101 days.

(21) Appl. No.: 12/216,580

(22) Filed: Jul. 8, 2008

(65) Prior Publication Data

US 2009/0027313 A1 Jan. 29, 2009

(30) Foreign Application Priority Data

Jul. 23, 2007 (JP) ..... 2007-191213

(51) Int. Cl.
*G09G 3/30* (2006.01)

(52) U.S. Cl.
USPC ..... 345/77; 345/76; 345/204; 345/211; 250/200; 250/552; 250/553; 315/169.3

(58) Field of Classification Search
USPC ..... 345/76–83, 204, 211; 315/169.3; 250/200, 552, 553
See application file for complete search history.

(56) References Cited

U.S. PATENT DOCUMENTS 6,501,230 B1 * 12/2002 Feldman ..... 315/169.3
2002/0101395 A1 * 8/2002 Inukai ..... 345/83
2003/0063053 A1 * 4/2003 Yamazaki et al. ..... 345/82
2003/0063081 A1 * 4/2003 Kimura et al. ..... 345/211
2004/0070558 A1 * 4/2004 Cok et al. ..... 345/76
2004/0263444 A1 * 12/2004 Kimura ..... 345/82
2005/0110720 A1 * 5/2005 Akimoto et al. ..... 345/76
2005/0156831 A1 * 7/2005 Yamazaki et al. ..... 345/76
2005/0259099 A1 * 11/2005 Jo et al. ..... 345/211
2006/0071886 A1 * 4/2006 Johnson et al. ..... 345/77
2006/0139238 A1 6/2006 Chiba et al.
2007/0091036 A1 * 4/2007 Han et al. ..... 345/82
2007/0188423 A1 * 8/2007 Kasai et al. ..... 345/76
2007/0268218 A1 * 11/2007 Mizukoshi et al. ..... 345/76
2007/0273703 A1 * 11/2007 Rumreich ..... 345/581
2008/0030438 A1 * 2/2008 Marx et al. ..... 345/82
2008/0218451 A1 * 9/2008 Miyamoto et al. ..... 345/76

FOREIGN PATENT DOCUMENTS

JP 2006-195312 1/2005
JP 2006-184648 A 7/2006
WO WO2005/109389 11/2005

* cited by examiner

*Primary Examiner* — Lun-Yi Lao
*Assistant Examiner* — Priyank Shah
(74) *Attorney, Agent, or Firm* — Stites & Harbison PLLC; Juan Carlos A. Marquez, Esq.

(57) ABSTRACT

To determine a deterioration and maintain a high-quality image without unevenness of brightness by performing a precise correction, a detection scanning line for selecting a pixel which detects a deterioration of a pixel, a detection line for informing the outside of the display area of the property of a pixel selected for detecting the deterioration, a deterioration determination means for determining a deterioration amount based on a voltage corresponding to a current detected by the detection line, and a deterioration correction means (computation circuit) for reflecting the determination result of the deterioration determination means in image data supplied to the pixel, are provided.

6 Claims, 9 Drawing Sheets

IMAGING DEVICE

CLAIM OF PRIORITY

The present application claims priority from Japanese patent application JP 2007-191213 filed on Jul. 23, 2007, the content of which is hereby incorporated by reference into this application.

FIELD OF THE INVENTION

The present invention relates to an imaging device using a display panel wherein self-luminous elements are disposed in a matrix array, and in particular relates to an imaging device wherein image quality can be maintained by detecting burnout of the self-luminous elements, and correcting for the burnout.

BACKGROUND OF THE INVENTION

An imaging device using a self-luminous display panel formed by self-luminous elements such as organic light emitting diodes (referred to hereafter as OLED) is known. This imaging device using self-luminous display elements has high visibility, does not require an auxiliary lighting device such as a backlight in a liquid crystal panel, and has a high response speed. Organic EL elements which are typical self-luminous display elements driven by current suffer so-called burnout and impairment due to time-dependent deterioration or high brightness operation over long periods of time at certain positions of the display, so the brightness decreases at these positions, causing a remarkable difference in brightness from the surrounding pixels, and resulting in an unevenly bright image display. In an imaging device using organic EL elements, this unevenness in brightness due to burnout must be corrected. JP-A-2006-195312 gives details of the detection of burnout in organic EL elements and its correction. In the following description, "burnout" and "deterioration" are used with identical meanings.

SUMMARY OF THE INVENTION

In JP-A-2006-195312, a reference pixel for determining burnout is provided, the difference of deterioration amount between the pixels in the display area and the reference pixel is computed, and this is fed back to the input signal.

However, when the difference of deterioration between the pixels and the reference pixel is computed to correct for burnout, due to the initial difference in characteristics of the pixels and their inherent temperature dependence, it is difficult to compute a precise correction amount. In particular, since the characteristics of organic EL elements have a strong temperature dependence, due to the in-screen temperature gradient of the display panel when light is emitted, the characteristics of the pixels and the reference pixel are significantly different and lead to errors in determining the deterioration. As a result, it is difficult to compute the correction amount.

It is therefore an object of the present invention to eliminate errors in determining the deterioration, and maintain a high image quality without unevenness in brightness by applying a precise correction.

To achieve the above objects, the present invention has the following features:

(1) The display area of the display panel is divided into areas containing plural pixels, and a burnout reference value is set for each area.

(2) The display area is divided so that the brightness gradation due to temperature gradients in the divided areas does not exceed about one grayscale.

(3) As a reference for determining the burnout in each divided area, the minimum value, maximum value and average value of the pixels in the divided area are used.

The imaging device of the invention has a display area wherein plural pixels consisting of self-luminous elements are disposed at the intersections of display scanning lines and signal lines, a display scanning circuit for applying a scanning signal to the display scanning lines, a signal drive circuit for supplying image data to the signal lines, and a power supply circuit for supplying current to the pixels.

The imaging device includes: detection scanning lines that select pixels, detection lines that detect the property of the selected pixels outside the display area, a deterioration determination means that determines a deterioration amount based on the detected signal corresponding to the property of the pixels detected by the detection lines, and a deterioration correction means (computation circuit) that reflects the determination result of the deterioration detection means in image data supplied to and displayed by the pixels.

If a reference for the determination is set for each position within the display area, the effect of the temperature gradient in the display area and the difference between initial characteristics on the determination of burnout can be eliminated. According to the present invention, the image quality of the display panel using the organic EL elements is improved, and its lifetime can be extended.

DETAILED DESCRIPTION OF THE PREFERRED EMBODIMENTS

Figure 1:
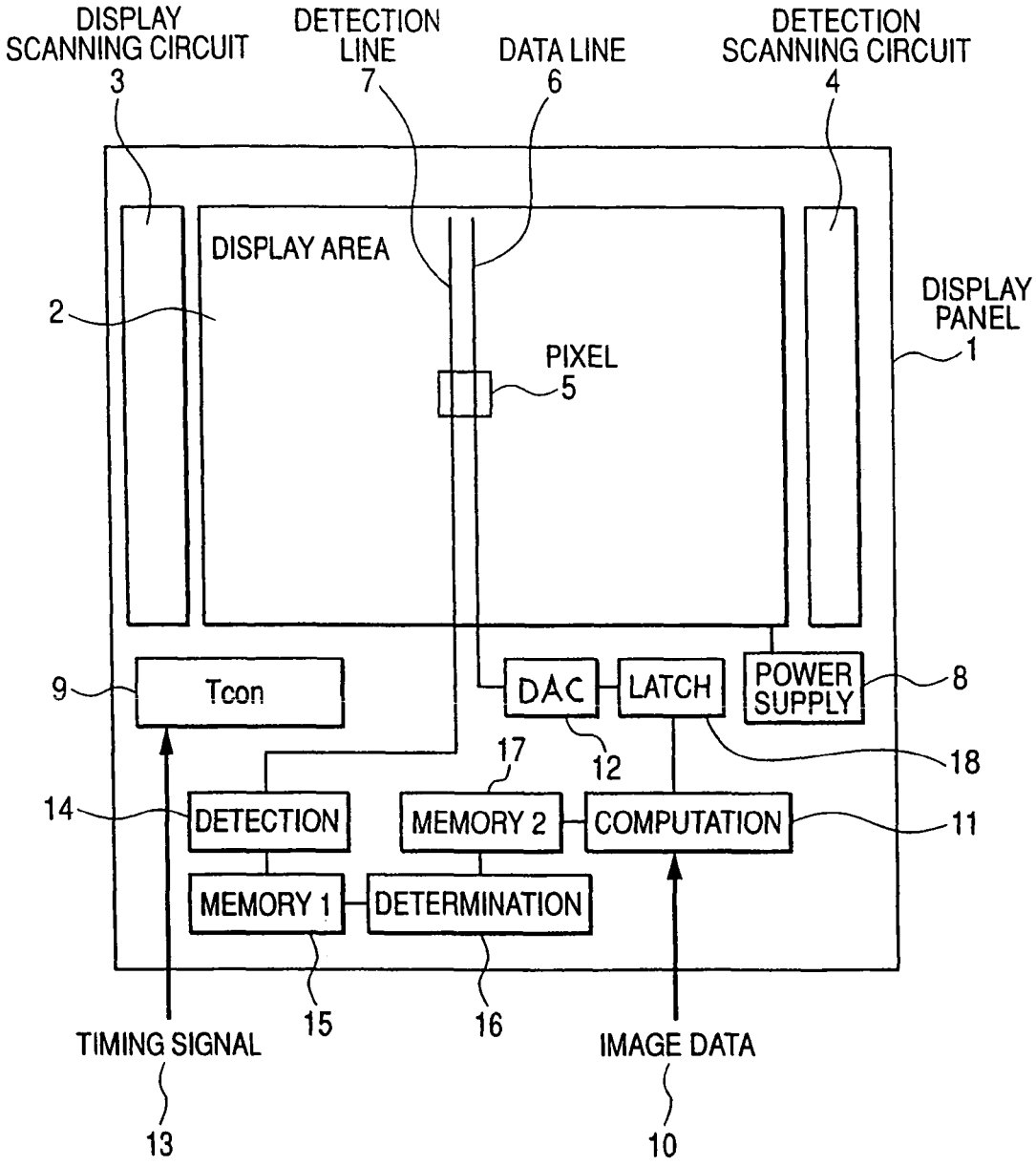
FIG. 1 is a diagram showing a first embodiment of a display panel using organic EL elements having a function for correcting pixel burnout according to the invention.

The invention will now be described in detail by way of specific embodiments, referring to the drawings.

Prior Art Embodiment

FIG. 1 is a drawing illustrative of a first embodiment of a display panel using organic EL elements having a function for correcting pixel burnout according to the invention. A display panel 1 has a display area 2 wherein plural pixels 5 are disposed in a matrix, on either side of which are disposed a display scanning circuit 3 and a detection scanning circuit 4 that scan and select pixels when a deterioration, i.e., a burnout, is detected.

In other parts of the display panel 1 are mounted a power supply 8, timing converter (Tcon) 9, computation circuit 11, digital/analog converter (DAC) 12, detection circuit (voltage detection circuit) 14, first memory (memory 1) 15, determination circuit 16, second memory (memory 2) 17, and latch circuit 18. The converter (Tcon) 9 generates various clock signals clock required for the display and other timing signals based on a timing signal inputted from an external signal source (host).

In FIG. 1, a detection line 7 is provided to extract the characteristics of the organic EL elements forming the pixels 5 in the display area 2 of the display panel 1 to the outside. The electrical characteristics (voltage values) of the organic EL elements output from the detection line 7 are detected, and this detection data is stored in the first memory 15. Next, the presence or absence of burnout and the deterioration amount are detected by the determination circuit 16, and the burnout amount is stored in the second memory 17. This burnout amount is corrected by for example adding it to image data 10 input from the external signal source (host) in the computation circuit 11, the image data to which the correction has been added is held by the latch circuit 18, and is then written to the pixels 5 via the DAC 12.

Figure 2:
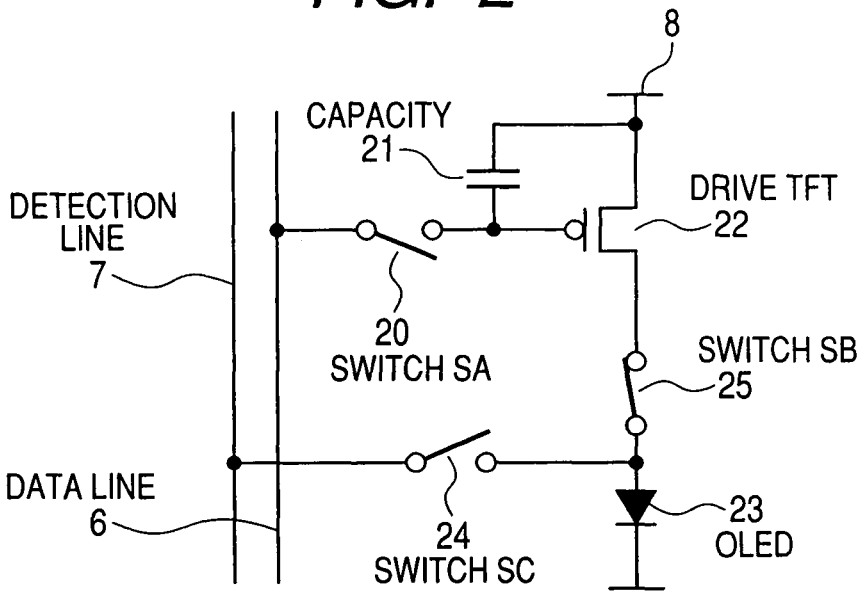
FIG. 2 is a diagram of essential parts showing a configurational example of a pixel in FIG. 1.

FIG. 2 is a diagram of essential components showing a typical construction of a pixel in FIG. 1. This pixel has a switch (SA) 20 which writes display data from the data line 6, capacitance 21, organic EL drive thin-film transistor (drive TFT) 22, organic EL element (OLED) 23, and light-up switch (SB) 25. A switch (SC) 24 that detects the characteristics of the organic EL element (OLED) 23 is provided, the switch (SC) 24 is controlled the detection scanning circuit 4, and the anode terminal of the organic EL element (OLED) 23 is connected to the detection line 7 when the switch (SC) 24 is turned on. Since the detection line 7 is connected to outside the display area 2 shown in FIG. 1, turning on the switch (SC) 24 enables the detection of property data of the selected pixel from outside the display area 2 via the detection line 7. The scanning lines driven by the scanning circuits 3, 4 of FIG. 1 are not shown.

Figure 3:
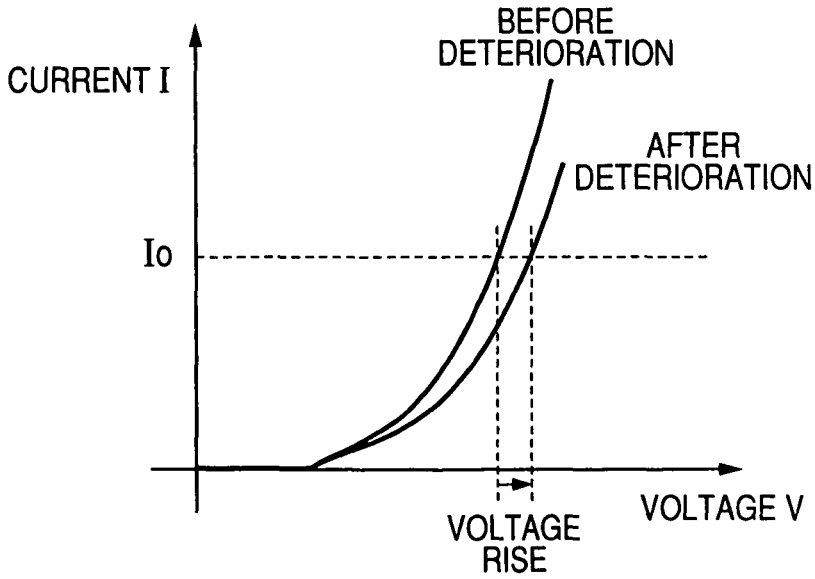
FIG. 3 is a diagram showing deterioration due to burnout of an organic EL element.

FIG. 3 is a diagram showing the deterioration due to burnout of the organic EL elements. The horizontal axis shows voltage (V), and the vertical axis shows current (I). The voltage required to generate the current required to make the organic EL element emit light at a predetermined brightness increases, as shown by the change of characteristics before and after deterioration shown in FIG. 3.

Figure 4:
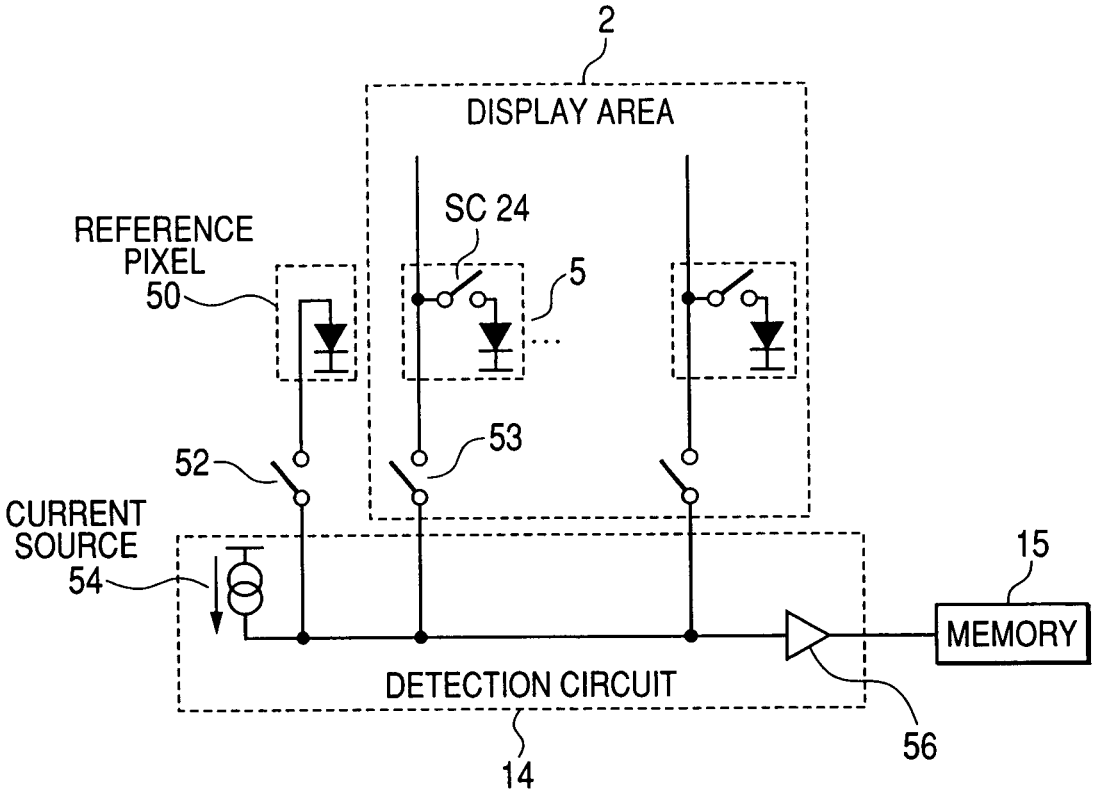
FIG. 4 is a descriptive diagram of a prior example of a detection circuit with an organic EL element characteristic.

FIG. 4 is a diagram showing a prior art embodiment of the burnout detection circuit of the organic EL imaging device. In this example, the reference pixel 50 is provided outside the display area 2. The reference pixel 50 is shown only by the organic EL element, whereas the pixel 5 in the display area 2 is shown by the organic EL element 23 and the switch (SC) 24 of FIG. 2. The detection circuit 14 is formed of a current source 54 and buffer amplifier 56, and detects the voltage applied to the organic EL elements when a constant current is applied to the reference pixel 50 and a selected arbitrary pixel 5 in the display area 2 from the current source 54. The detected voltage is stored in the first memory 15 via the buffer amplifier 56.

The measurement procedure is that, first, the switch 52 is switched ON and a predetermined fixed current is passed to the reference pixel 50 from the current source 54. At this time, the switch 53 corresponding to the pixel 5 of the display area is OFF. The voltage drop of the reference pixel 50 due to this current is stored in the memory 15 via the buffer amplifier 56 as the detected voltage. Next, the switch 52 is switched OFF, the switch 53 corresponding to the pixel 5 is switched ON, and a predetermined fixed current is passed from the current source 54. The pixels 5 are selected by turning on the switch (SC) 24 and the switch 53 with the detection scanning circuit 4 in FIG. 1. The voltage drop of the pixel 5 due to this current is stored in the memory 15 via the buffer amplifier 56 as the detected voltage.

Figure 5:
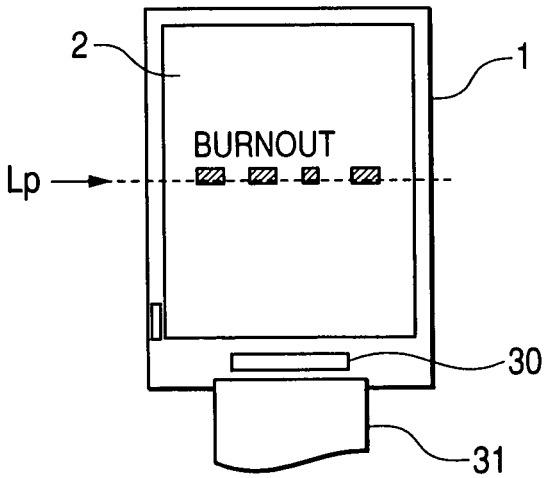
FIG. 5 is a plan view showing an example of a problem in a display panel having pixels where burnout has occurred.

FIG. 5 is a plan view showing an example of a display panel where the pixels are subject to burnout. The major part of the display panel 1 has a display area 2. A drive circuit chip 3 is mounted on a part of a board forming the display panel 1, and a flexible printed circuit board 31 connected to the external power supply (host) is attached to a terminal led out from an edge.

Figure 6:
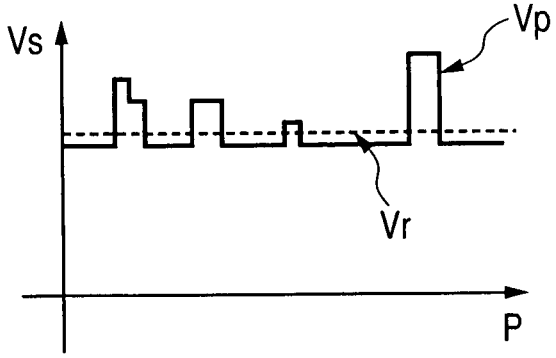
FIG. 6 is a waveform diagram showing an example where the organic EL characteristics of a pixel on a scanning line shown by a dotted line in the display area of the display panel shown in FIG. 5, are detected.

FIG. 6 shows an example of detecting, with the detection circuit in FIG. 4, the organic EL characteristics of the pixels on a scanning line shown by the dotted line in the display area 2 of the display panel shown in FIG. 5. In FIG. 6, the horizontal axis shows positions P along the detection scanning line Lp shown by the arrow in the display area 2 in FIG. 5, and the vertical axis shows the detected voltage Vs. The dotted line is the detected voltage Vr of a reference pixel. For a deteriorated pixel, since the voltage rises when a current is passed, the detected voltage Vp has the rectangular waveform in FIG. 6. The voltage Vp having this waveform is detected, and by comparing it with the voltage Vr obtained by measuring the reference pixel, the presence or absence of deterioration is determined.

First Embodiment

Figure 7:
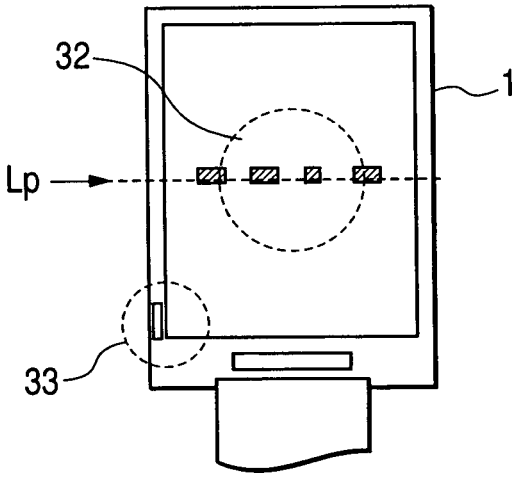
FIG. 7 is a plan view showing a display panel of the invention identical to that of FIG. 5 showing a problem when temperature dependence characteristics are taken into consideration.
Figure 8:
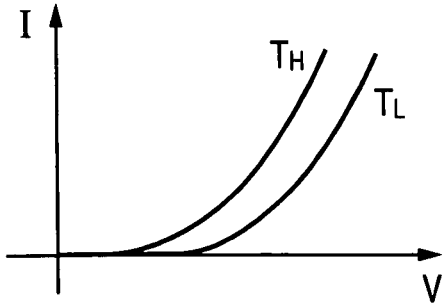
FIG. 8 is a voltage-current characteristic diagram describing a temperature dependence of an organic EL element.
Figure 9:
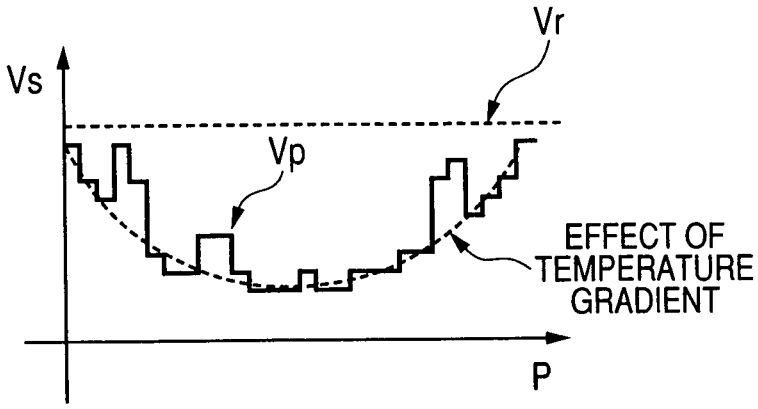
FIG. 9 is a waveform diagram identical to that of FIG. 6 which varies due to temperature dependence of an organic EL element.

The prior art embodiment shows a method for detecting a pixel property where it was not necessary to consider the effect of temperature dependence, initial property, etc. of the pixels 5 in the display area. Hereafter, an embodiment will be described where the effect of temperature dependence is taken into consideration. FIG. 7 is a plan view showing a display panel identical to that of FIG. 5 describing the problem when temperature dependence is taken into consideration. FIG. 8 is a voltage-current characteristic diagram illustrative of the temperature dependence of an organic EL element. FIG. 9 is a waveform diagram identical to that of FIG. 6 that changes due to temperature dependence of the organic EL element. When the display panel using the organic EL element is illuminated, the panel temperature rises. In particular, since the temperature rise in the center (high-temperature part) of the display panel 2 is sharp, and there is a low temperature part 33 on the edge of the display panel as shown in FIG. 7, a temperature gradient is produced in the screen of the display panel 2.

Figure 10:
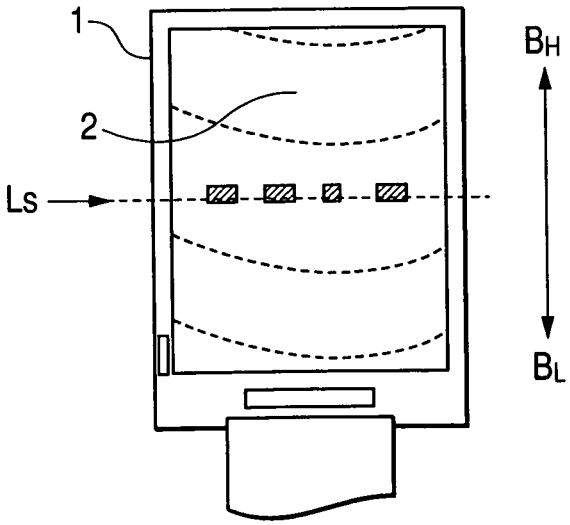
FIG. 10 is a plan view showing another problem in a display panel having pixels where burnout has occurred.
Figure 11:
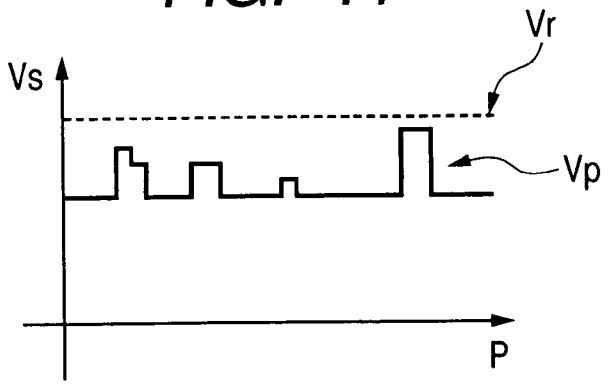
FIG. 11 is a waveform diagram showing an example where the organic EL element characteristics of a pixel on a detection scanning line shown by the dotted line in the display area of the display panel shown in FIG. 10, are detected.

For example, if a display panel (organic EL panel) using mobile organic EL elements of about 3 inches is illuminated to the extent of several hundred cd/m$^2$, a temperature difference of 10° C. or more occurs between the edge (low temperature part 33) and the center part of the display panel (this value will differ depending on the thermal design of the display panel). Here, considering the temperature dependence of the characteristics of the organic EL element, as shown in FIG. 8, the voltage required to pass a fixed current through the organic EL element is lower at high temperature. This proportion depends on the material, and attains several tens of mV/° C. When a temperature difference of 10° C. $B_L$ below the display area, as shown by the curved dotted lines. FIG. 11 is a waveform diagram showing an example where the organic EL characteristics of a pixel on a detection scanning line shown by the dotted line in the display area of the display panel shown in FIG. 10 are detected. In this display panel, if brightness is detected along the detection scanning line Ls shown by the arrow, as shown in FIG. 11, the detected voltage Vp is less than the reference voltage Vr, and it is difficult to detect burnout precisely.

Figure 12:
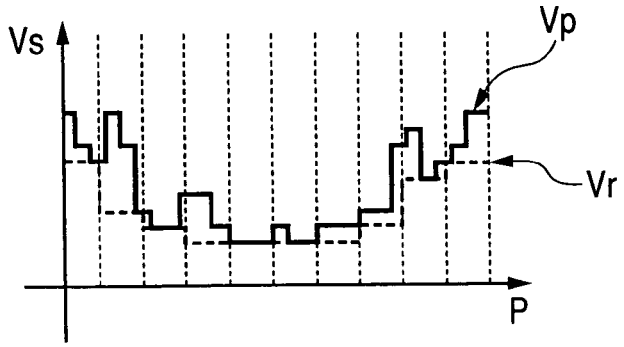
FIG. 12 is a waveform diagram identical to that of FIG. 9 describing a burnout determination method according to the invention.

In order to solve the above problem, this invention provides a new method for deciding a determination reference of pixel burnout. FIG. 12 is a waveform diagram identical to that of FIG. 9 the purpose of describing the method of determining burnout according to the invention. For example, in the detection signal of a panel having a temperature gradient, an erroneous determination may occur. Hence, as shown in FIG. 12, the panel is divided into plural blocks according to the detection position of the detection signal, and a determination reference is set for each block. Due to this, the effect of a change of the detection signal due to the temperature gradient and scattering in the initial characteristics can be eliminated. Specifically, the change in the detection signal due to the temperature gradient and scatter in the initial characteristics is more gradual compared to change in the detection signal due to burnout. Hence, by setting the small blocks of FIG. 12, the variation in reference voltage between blocks can be made not to exceed one grayscale, only steep components are detected from the variation in the detection signal, and the effect of the temperature gradient can be eliminated.

Figure 13:
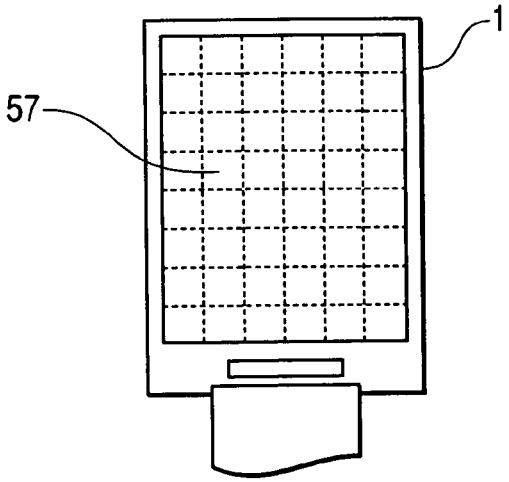
FIG. 13 is a plan view describing an example where the display area of the display panel has been divided.

FIG. 13 is a plan view showing an example where the display area of the display panel is divided. Here, it is divided into 48 blocks extending 8 blocks vertically and 6 blocks horizontally. In the example of FIG. 12, plural reference values are set within one scanning line. In FIG. 13, by setting the blocks in two dimensions, the block 57 can be set large, the number of reference settings can be decreased, and the effect of the offset of the references can be suppressed.

Figure 14:
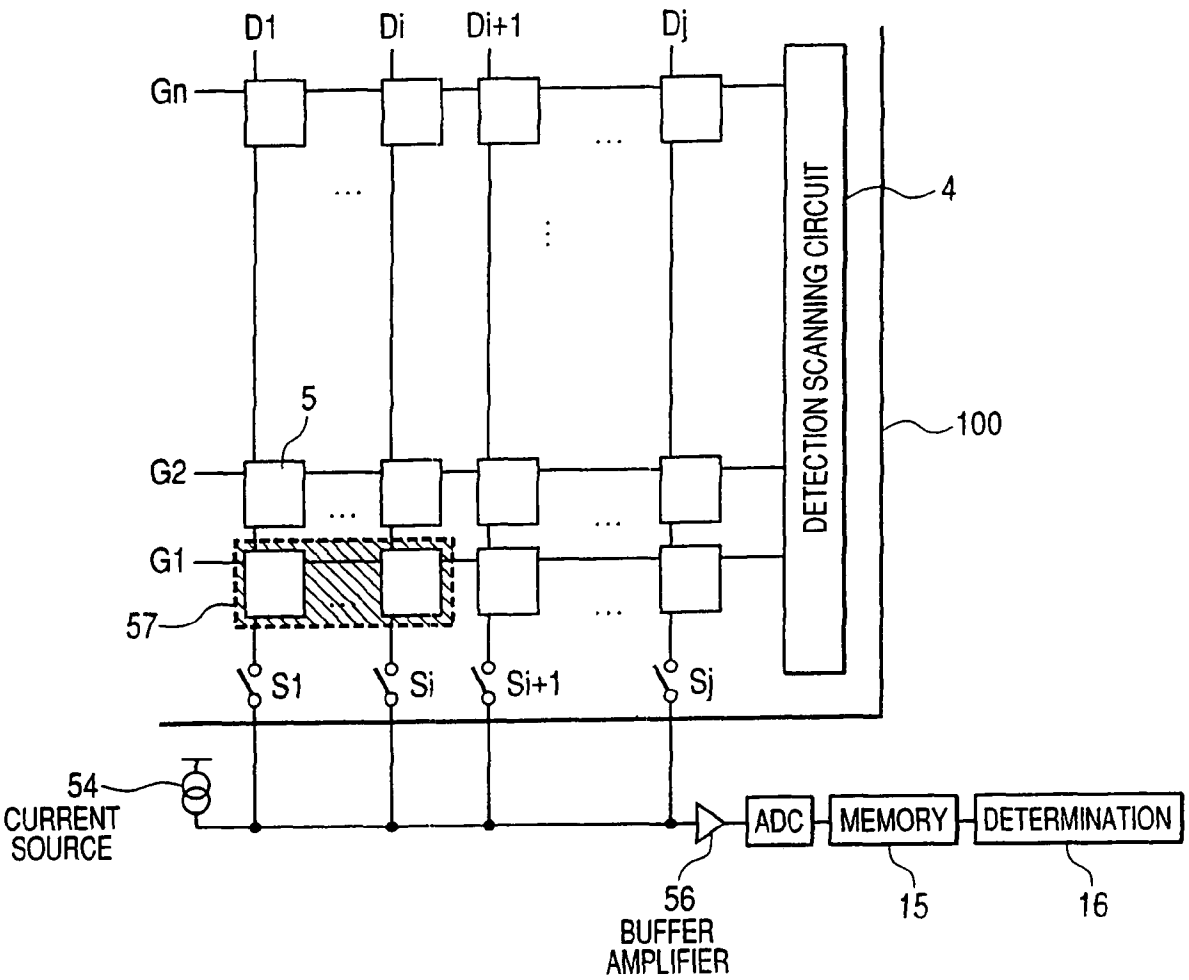
FIG. 14 is a diagram of essential components describing an imaging device having a function for detecting and determining pixel burnout according to a first embodiment of the invention.

FIG. 14 is a diagram of essential components describing an imaging device having a function for detecting and determining pixel burnout according to the first embodiment. The area with the shaded part in FIG. 14 is one of the blocks 57, burnout detection and determination being performed in this block unit. First, a scanning line G1 is selected by the detection scanning circuit 4. During selection of the scanning line G1, switches S1, Si, . . . Si+1, . . . Sj connected to signal lines D1, Di, . . . Di+1, . . . Dj are switched ON one after the other.

Due to this, all the pixels 5 in the block 57 are selected sequentially. At this time, a fixed current is applied to the organic EL elements of the pixels 5 from the current source, and a corresponding voltage is applied to the buffer amplifier 56. This voltage is output by the buffer amplifier 56 at a low impedance, converted to digital data by the analog/digital converter ADC, and stored in the first memory 15. After detection data for all the pixels has been stored in the first memory 15, the minimum value of the data is set as a reference value. This reference value is not limited to the minimum value, and may be the maximum value or the average value of the data in the block 57, or a value calculated by appropriate computation based on all detected data. The determination circuit 16, by comparing this reference value with the detection value for the pixels, determines their degree of deterioration. Next, by determining burnout for the following blocks one after the other in the same way, burnout is determined for the whole screen.

The determination results are stored in the second memory 17 of FIG. 1. This burnout is corrected by adding it to the image data 10 input from the external signal source 10 (host) with the computation circuit 11, the corrected image data is held by the latch 18, and written to the pixels 5 via the DAC 12.

According to the first embodiment, the effects of the temperature gradient and differences of initial characteristics on the determination of burnout are eliminated, and burnout can be corrected without any determination errors. Hence, an imaging device of high-quality and extended lifetime can be provided.

Second Embodiment

Figure 15:
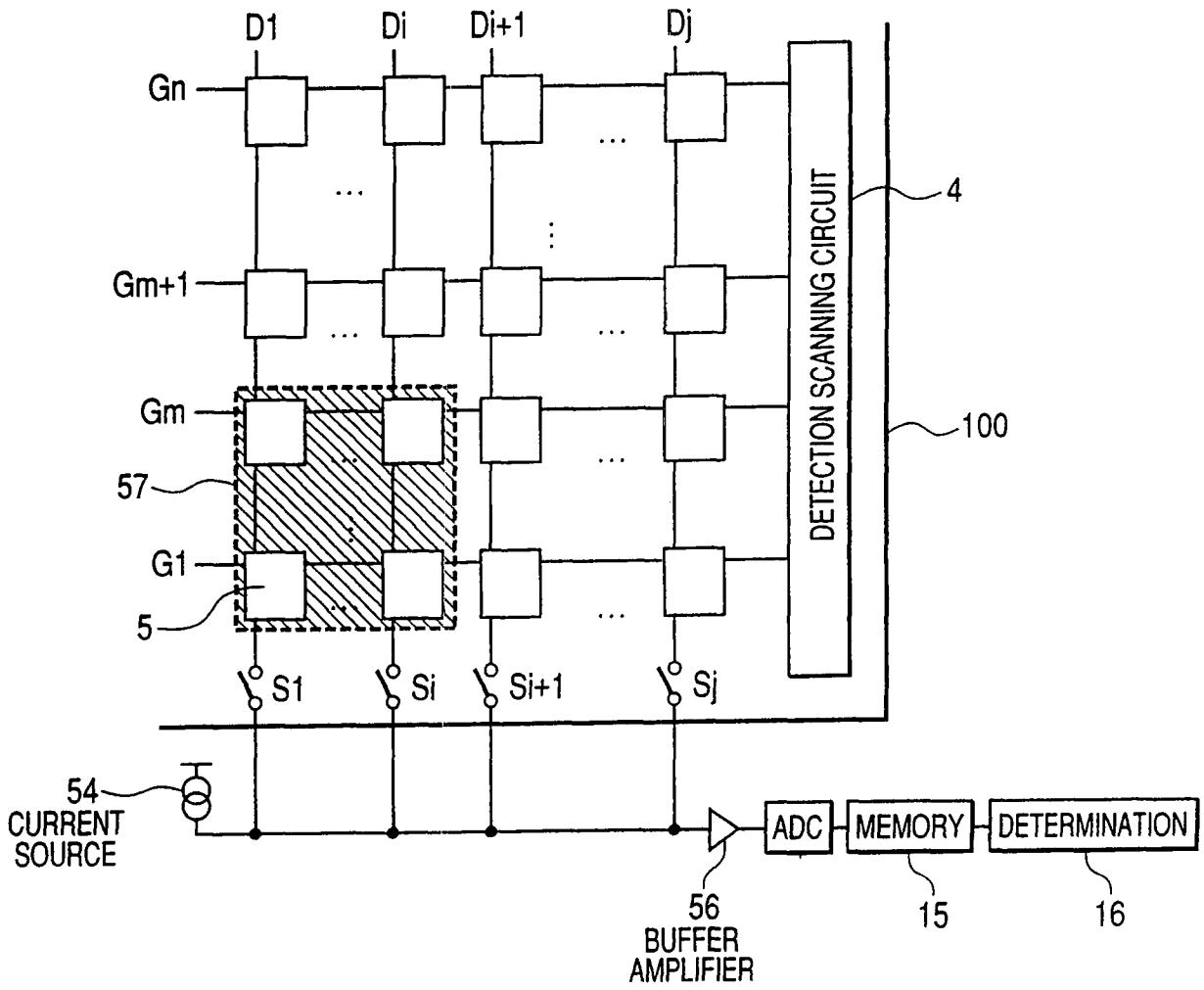
FIG. 15 is a diagram of essential components describing an imaging device having a function for detecting and determining pixel burnout according to a second embodiment of the invention.

FIG. 15 is a diagram of essential components describing an imaging device having a function for detecting and determining pixel burnout according to a second embodiment of the invention. According to this embodiment, plural pixels 5 in areas 57 shaded in FIG. 15 are taken as one of the blocks 57, and burnout detection and determination are performed in this block unit. First, the scanning lines G1 to Gm of the area 57 are selected sequentially by the detection scanning circuit 4, and switches the S1 to Si are selected sequentially while one scanning line is selected. To do this, all of the pixels 5 in the block 57 are selected sequentially.

A fixed current is passed through the selected pixels 5 from the current source. A voltage generated in the organic EL due to this fixed current is input to the buffer amplifier 56, and input to the analog/digital converter ADC at a low impedance. The analog/digital converter ADC converts this voltage to digital data, and stores it in the first memory 15. After detection data for all the pixels in the area 57 are stored in the memory 15, their minimum value is taken as a reference value. This reference value is not limited to the minimum value, and may be the maximum value or the average value of the data in the block 57, or a value calculated by appropriate computation based on all detected data. The determination circuit 16, by comparing this reference value with the detection value for the pixels, determines the degree of deterioration. Next, by determining the burnout for each block, the burnout for the whole screen is determined.

The determination results are stored in the second memory 17 identical to that of FIG. 1. The subsequent procedure is identical to that of FIG. 14, wherein the burnout is added to the image data 10 input from the external signal source (host) by the computation circuit 11 for correction, the corrected image data is held by the latch 18, and written to the pixels 5 via the DAC 12.

According to the second embodiment, the effects of the temperature gradient and differences of initial characteristics on the determination of burnout are eliminated, and burnout can be corrected without any determination errors. Hence, an imaging device of high-quality and extended lifetime can be provided.

Third Embodiment

Figure 16:
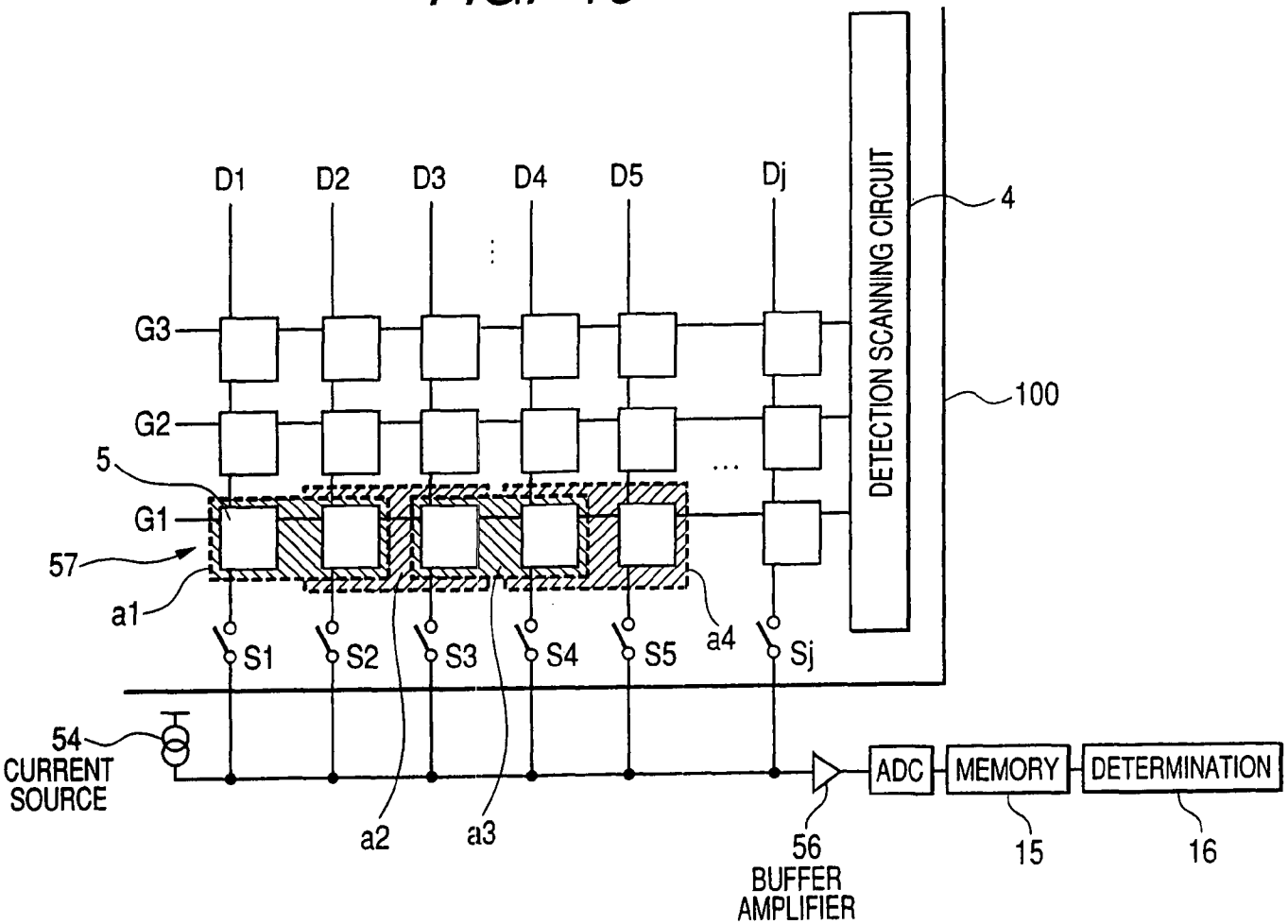
FIG. 16 is a diagram of essential components describing an imaging device having a function for detecting and determining pixel burnout according to a third embodiment of the invention.

FIG. 16 is a diagram of essential components showing an imaging device having a function for detecting and determining pixel burnout according to a third embodiment of the invention. In this embodiment, the block 57 is formed by two adjacent pixels 5 in the scanning line direction shown by a1, a2, a3, a4, . . . , and burnout is determined by comparing with the adjacent pixel. The detection and determination procedure is as follows. First, one scanning line, here the scanning line G1, is selected by the detection scanning circuit 4. While this scanning line G1 is selected, the switches S1 to Sj are switched ON one after another, a fixed current is passed from the current source 54, and the corresponding voltage is stored in the first memory 15 via the buffer amplifier 56 and ADC. After the characteristics of all the organic EL elements of the pixels 5 in one scanning line have been detected, the determination circuit 16 performs a comparison with adjacent pixels for the voltages of all the pixels stored in the first memory 15.

More precisely, the block 57 indicated by a1 is formed by 2 pixels 5 corresponds to signal lines D1 and D2, and the block 57 indicated by a2 is formed by 2 pixels 5 corresponds to signal lines D2 and D3. That is, the pixel 5 corresponds to signal line D2 belongs to a plurality of blocks indicated by both a1 and a2 which are adjacent blocks.

The determination results are integrated along the scanning lines and the integrated values in each pixel are stored in the second memory 17 for use as a deterioration degree. The remaining procedure is identical to that of FIG. 14 and FIG. 15, the burnout is added to the image data input from the external signal source (host) by the computation circuit 11, the corrected image data is held by the latch 18, and written to the pixels 5 via the DAC 12.

According to the third embodiment, the effects of the temperature gradient and differences of initial characteristics on the determination of burnout are eliminated, and burnout can be corrected without any determination errors. Hence, an imaging device of high-quality and extended lifetime can be provided.

What is claimed is:

1. An imaging device having a display area wherein plural pixels comprising self-luminous light elements are disposed at intersections of display scanning lines and signal lines, a display scanning circuit for applying a scanning signal to the display scanning lines, a signal drive circuit for supplying image data to the signal lines, and a power supply circuit for supplying current to the pixels, the device comprising:

detection scanning lines that select pixels to detect a deterioration of an image;

detection lines that inform the outside of the display area of the property of the selected pixels;

deterioration determination means that detects the property of the pixels via the detection lines and determines a deterioration amount based on the detected signal; and deterioration correction means that reflects the determination result of the deterioration determination means in image data supplied to and displayed by the pixels, wherein the display area includes a plurality of blocks arranged along the display scanning lines and the signal lines, each of the plurality of blocks being composed of a plurality of pixels selected by adjacent scanning lines and adjacent signal lines, the deterioration determination means is configured to calculate a first deterioration determination reference value corresponding to a first block of the plurality of blocks for determining a first deterioration of pixels in the first block and a second deterioration determination reference value corresponding to a second block of the plurality of blocks for determining a second deterioration of pixels in the second block, the deterioration determination means detects a first property of the pixels in the first block and determines a first deterioration amount based on the first property by using the first deterioration determination reference value, the deterioration determination means detects a second property of the pixels in the second block and determines a second deterioration amount based on the second property by using the second deterioration determination reference value, and the deterioration correction means reflects the first deterioration amount as the determination result of the deterioration determination means in the image data supplied to and displayed by the pixels in the first block and the second deterioration amount as the determination result of the deterioration determination means in the image data supplied to and displayed by the pixels in the second block.

2. The imaging device according to claim 1, wherein the deterioration determination means detects voltage values corresponding to properties of pixels forming the respective blocks, and wherein the determination reference value is a minimum value among the voltage values.

3. The imaging device according to claim 1, wherein the deterioration determination means detects voltage values corresponding to properties of pixels forming the respective blocks, and wherein the determination reference value is a maximum value among the voltage values.

4. The imaging device according to claim 1, wherein the deterioration determination means detects voltage values corresponding to properties of pixels forming the respective blocks, and wherein the determination reference value is an average value among the voltage values.

5. The imaging device according to claim 1, wherein the imaging device has a pixel that belongs to a plurality of blocks among adjacent blocks in the display area.

6. The imaging device according to claim 1, wherein the deterioration detection means includes:

a voltage detection circuit that detects a voltage value corresponding to the property of the pixels detected outside the display area via the detection lines;

a first memory that stores the voltage value detected by the voltage detection circuit; and a determination circuit that calculates the determination reference value based on the voltage value stored in the first memory and determines the deterioration amount by comparing the calculated determination reference value with the voltage value of a deterioration determination pixel, wherein the deterioration correction means includes:

a second memory that stores the deterioration amount of the pixels stored in the first memory;

a computation circuit that corrects externally input image data by the deterioration amount stored in the second memory;

a latch circuit that holds the image data corrected by the computation circuit; and a digital/analog converter that converts the image data held by the latch circuit to analog data, and supplies it to the data lines.

* * * * *